US008656619B2

(12) United States Patent
Popikov

(10) Patent No.: US 8,656,619 B2
(45) Date of Patent: Feb. 25, 2014

(54) TRIGGER MECHANISM OF A REPEATING RIFLE

(75) Inventor: Sergiej Popikov, Weitnau (DE)

(73) Assignee: Blaser Finanzholding GmbH, Isny (DE)

( * ) Notice: Subject to any disclaimer, the term of this patent is extended or adjusted under 35 U.S.C. 154(b) by 110 days.

(21) Appl. No.: 13/297,392

(22) Filed: Nov. 16, 2011

(65) Prior Publication Data

US 2012/0117842 A1 May 17, 2012

(30) Foreign Application Priority Data

Nov. 17, 2010 (DE) ..... 10 2010 051 641

(51) Int. Cl.
*F41A 19/00* (2006.01)

(52) U.S. Cl.
USPC ..... 42/69.01; 89/132; 89/136

(58) Field of Classification Search
USPC ..... 42/69.01–69.03; 89/132–154
See application file for complete search history.

(56) References Cited

U.S. PATENT DOCUMENTS

| | | | | | |
|---|---|---|---|---|---|
| 1,909,425 | A | * | 5/1933 | Reid | 42/69.01 |
| 2,136,511 | A | * | 11/1938 | Jones | 42/69.01 |
| 2,289,098 | A | * | 7/1942 | Buhmiller | 42/23 |
| 2,341,299 | A | * | 2/1944 | Sweany | 42/69.01 |
| 2,557,415 | A | * | 6/1951 | Dayton | 42/69.01 |
| 3,337,979 | A | * | 8/1967 | Freed | 42/65 |
| 3,550,301 | A | * | 12/1970 | Shesterikov | 42/69.01 |
| 2006/0086031 | A1 | | 4/2006 | Geissele | |

FOREIGN PATENT DOCUMENTS

| | | | |
|---|---|---|---|
| DE | 688363 | C | 2/1940 |
| DE | 4402951 | A1 | 8/1995 |
| DE | 10008394 | C1 | 7/2001 |

* cited by examiner

*Primary Examiner* — Samir Abdosh
(74) *Attorney, Agent, or Firm* — Fleit Gibbons Gutman Bongini & Bianco PL; Martin Fleit; Paul D. Bianco

(57) ABSTRACT

The present invention relates to a trigger mechanism of a repeating rifle. The trigger mechanism has a sear nose that pivots about an axis and a bolt lock which is dedicated to the sear nose and which is connected to a trigger that pivots about a trigger axis and has a sear that meshes with a counter-sear. To make it possible to change the trigger characteristics simply and easily, the counter-sear is disposed on a stationary sear element and the bolt lock is disposed on the sear nose so as to be pivotable about an axis of rotation.

11 Claims, 5 Drawing Sheets

TRIGGER MECHANISM OF A REPEATING RIFLE

CROSS REFERENCE TO RELATED APPLICATION

This application claims priority under 35 U.S.C. §119 to German Patent Application No. 10 2010 051 641.4 filed Nov. 17, 2010, the entire contents of which are incorporated herein by reference.

FIELD OF THE INVENTION

The present invention relates to a trigger mechanism of a repeating rifle.

BACKGROUND OF THE INVENTION

In conventional trigger and sear mechanisms, the trigger lever has a sear which, in the cocked position, is supported by a counter-sear of a trigger leaf. When a shot is triggered in this type of trigger and sear system, the sears disengage and the trigger elements are separated from one another. In the prior-art trigger systems, the sear and the counter-sear must be manufactured with utmost precision and must be accurately matched to each other in order to obtain the trigger characteristics required. Because of the narrow tolerances and the necessary accurate interaction, changes to the trigger characteristics cannot be made without entailing certain problems. In addition, in particular, extreme conditions, such as high contamination, resinification or freezing, may lead to malfunctions. A mechanism in which the sears do not lock, e.g., prevents recocking of the lock, which makes refiring impossible. Under the aforementioned extreme conditions, the residual risk of the conventional trigger and sear systems is that after the trigger is pulled, the sear nose remains in its position and does not release the firing pin.

SUMMARY OF THE INVENTION

In one embodiment, a problem to be solved by the present invention is to make available a trigger mechanism of the aforementioned type, which can be produced inexpensively, which allows the trigger characteristics to be changed simply and easily, and which ensures excellent functionality and high safety even under extreme conditions.

This problem is solved by a trigger mechanism as set forth herein. Useful designs and preferred advanced embodiments of the invention are also disclosed.

In the trigger mechanism according to the present invention, the bolt lock which is dedicated to a sear nose for holding or releasing a firing pin assembly is pivoted about an axis of rotation on the sear nose. The counter sear which interacts with the sear on the bolt lock, on the other hand, is disposed on a stationary sear element. Using this type of assembly, it is possible to ensure the functionality of the trigger mechanisms with components that can be readily produced and that have larger tolerances. The components responsible for locking the sears can be easily modified, thereby making it possible to vary the trigger characteristics. In addition, the sear depth is ensured even if the range of tolerance is wide. The trigger mechanism makes it possible to securely lock the sears and provides especially secure protection against a release of the trigger in the drop test.

In an especially useful embodiment, the bolt lock is actuated by a compression spring that is disposed in the sear nose in such a manner that the sear on the bolt lock is pushed in the direction of the counter-sear. Because of the elastic pre-tension of the bolt lock, friction-mediated automatic locking takes place, which ensures excellent drop security and high protection against undesirable firing of a shot. The compression spring is integrated into the sear nose, which makes for compact construction.

The pre-tension of the compression spring can preferably be changed by means of an adjusting screw or another type of adjusting element. This makes it possible to adjust the trigger pull without having to dismount the compression spring in the sear nose.

In another useful embodiment of the invention, a control surface that meshes with a return cam on the stationary sear element is disposed on the bolt lock so as to be able to forcibly reset the bolt lock into the sear position. By means of the return cam and the control surface formed on the bolt lock to mesh with this return cam, it is also possible to forcibly reset the trigger mechanism if automatic resetting of the trigger element, which is normally effected by return springs, does not properly function, e.g., due to freezing, breakage of the spring, contamination or the like. Forcibly resetting the trigger element can be initiated, e.g., by moving the firing pin assembly, which normally occurs when the locking bolt mechanism is opened, which leads to additional safety.

The stationary sear element and the sear nose with the bolt lock which is pivotably disposed on the sear nose are preferably disposed in an insert. This makes it possible to simply incorporate the entire trigger unit in a receiver and, if required, also to quickly dismount and/or replace it.

BRIEF DESCRIPTION OF THE DRAWINGS

Additional special features and advantages of the present invention follow from the following description of a preferred practical example shown in the drawing. As can be seen.

DETAILED DESCRIPTION OF THE INVENTION

Figure 1:
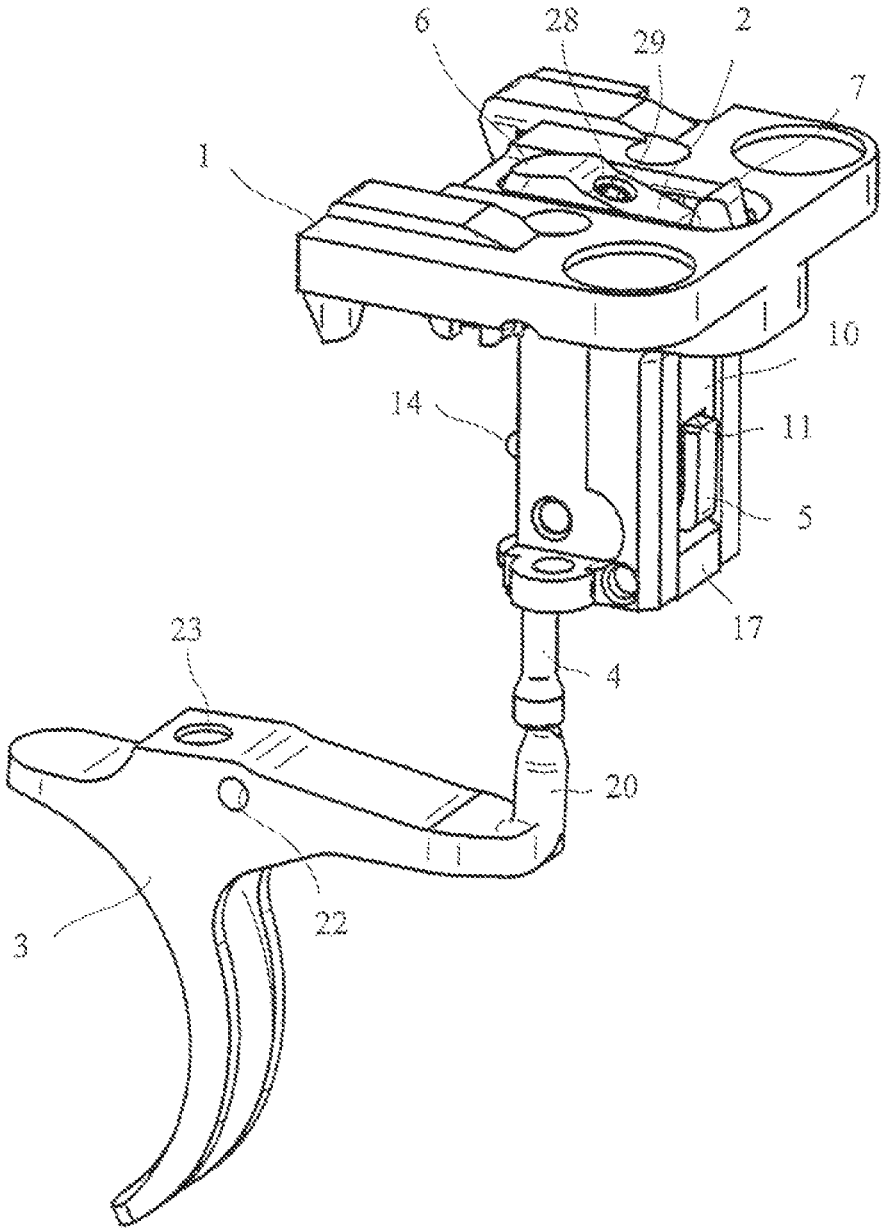
FIG. 1 shows a perspective view of a trigger mechanism of a repeating rifle.

The trigger mechanism shown in a perspective view in FIG. 1 comprises a sear nose 2 which is pivotably disposed within an insert 1 and which, via a pin-shaped connecting element 4 and a bolt lock 5, can be actuated by means of a trigger 3 which is pivotably disposed within a receiver of a repeating rifle.

The sear nose 2 makes it possible for a firing pin assembly (not shown) of the repeating rifle to be held in a cocked position and/or to be released for firing a shot. To this end, the sear nose 2 comprises a front nose 6 by means of which, e.g., a firing pin nut that is disposed on the end of a firing pin can be pushed upward against a stationary central axis, and thus the firing pin biased by a spring can be held in a cocked position in a manner known in the art. In addition, a rear return nose 7 which will be explained in greater detail below is disposed on the upper surface of the sear nose 2. By means of a return spring (not shown), the sear nose 2 is pre-tensioned in such a manner that the front nose 6 is pushed upward.

Figure 2:
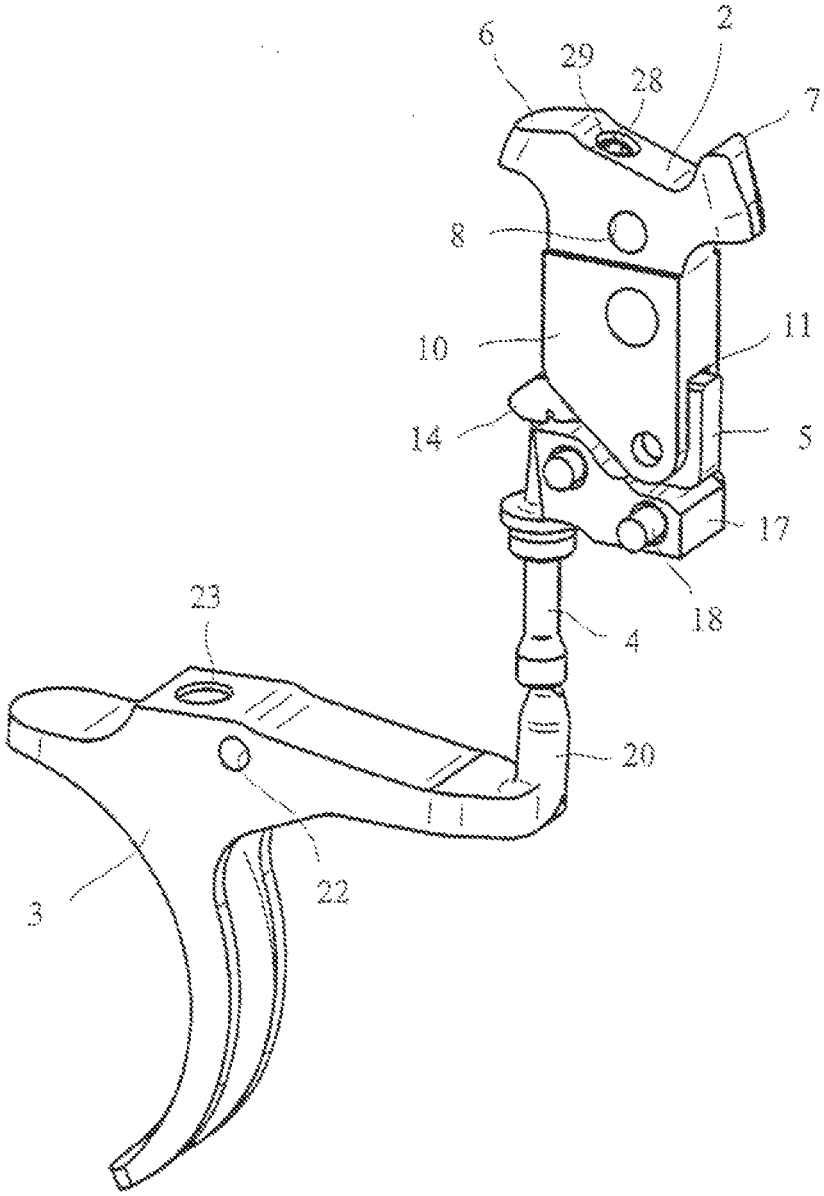
FIG. 2 shows the trigger mechanism shown in FIG. 1 without the insert.
Figure 3:
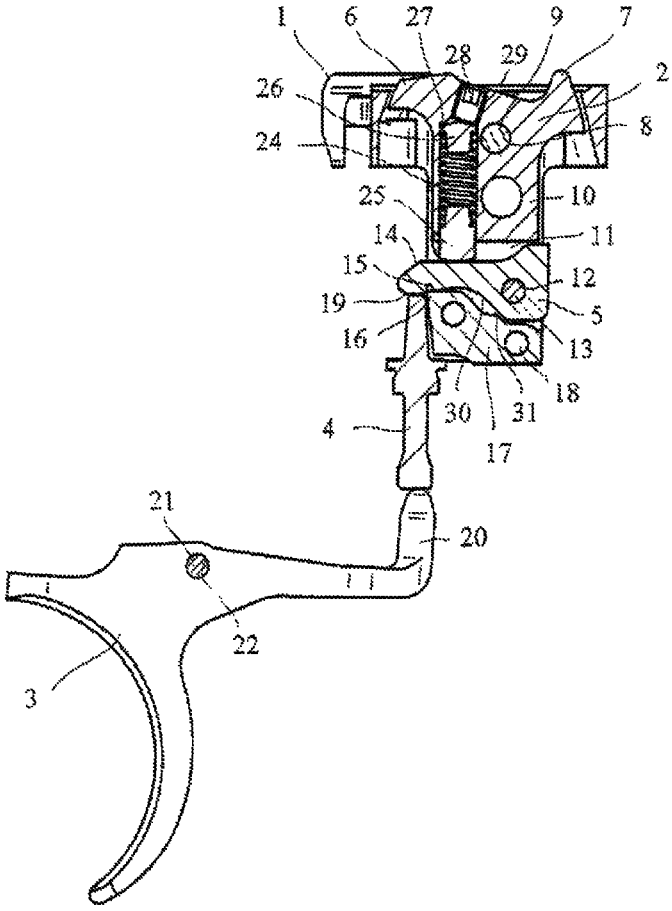
FIG. 3 shows the trigger mechanism of FIG. 1 in a locked position.
Figure 4:
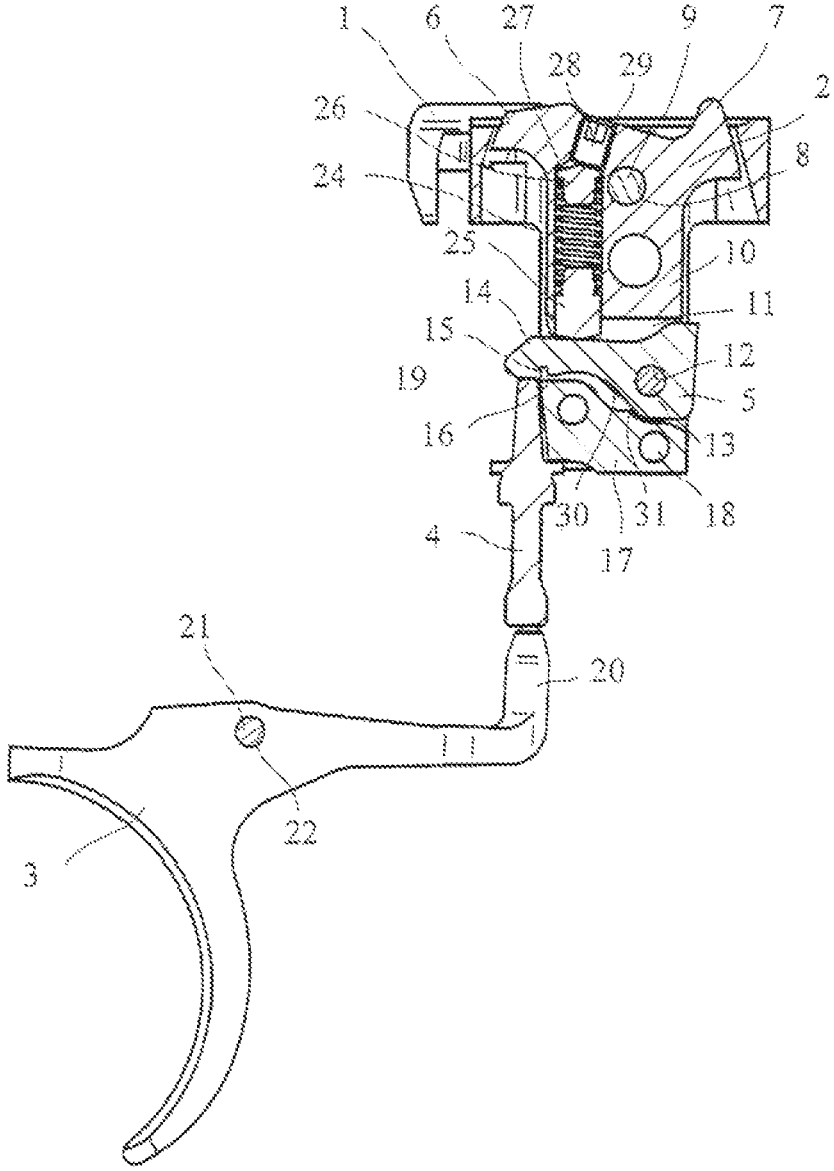
FIG. 4 shows the trigger mechanism of FIG. 1 in a release position.
Figure 5:
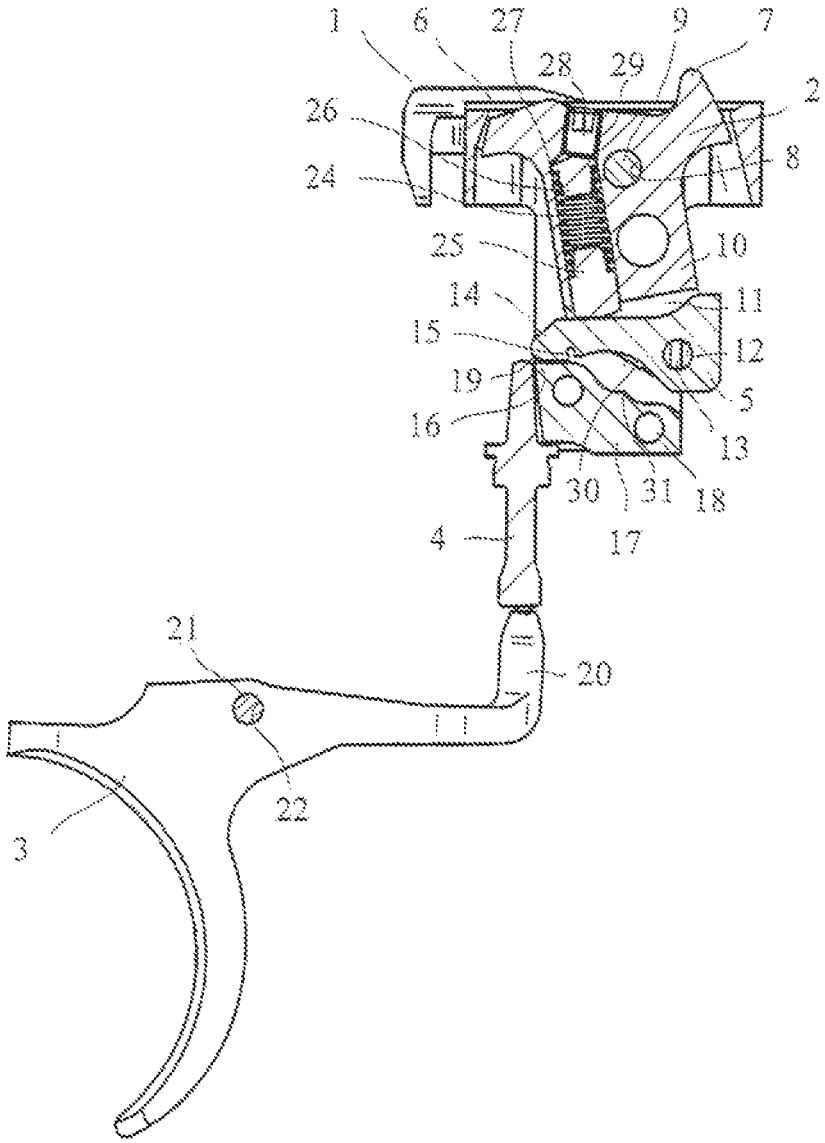
FIG. 5 shows the trigger mechanism of FIG. 1 in a firing position.

As the sectional views of FIGS. 3-5 indicate, the sear nose 2 which, via bearing bore 8, is pivotably disposed around an axis 9 within the insert 1 also has a bottom extension 10 (as shown in FIG. 2) with a slot-shaped groove 11 on the lower surface. Via a bearing bore 12, the bolt lock 5 is disposed so as to be pivotable about an axis of rotation 13 in the slot-shaped groove 11 on the bottom extension 10 of the sear nose 2. The axis of rotation 13 extends below the axis 9 at right angles through the bearing bore 12 of the bolt lock 5 and through the respective bores in the region of the groove 11 in the bottom extension 10 of the sear nose 2. The bolt lock 5 comprises a lever arm 14 which, relative to the axis of rotations 13, projects in the forward direction and which has a lower groove-shaped sear 15 which, in the cocked position shown in FIG. 3, meshes with a counter-sear 16 of a stationary sear element 17, which counter-sear has the shape of a sear edge. In the embodiment shown, the stationary sear element 17 is affixed inside the insert 1 shown in FIG. 2 by means of two transverse pins 18.

On the end which, relative to the stationary sear element 17, projects in the forward direction, the lever arm 14 and the bolt lock 5, which is pivotably disposed on the sear nose 2, furthermore comprises a lower contact surface 19 against which the upper end of the pin-shaped connecting element 4 is resting. The lower end of the pin-shaped connecting element 4, which is disposed so as to be able to move in the vertical direction inside the receiver, on the other hand, rests against an upward-projecting extension 20 on the back end of trigger 3 which, via a bore 21, can pivot about a trigger axis 22. The trigger 3 is actuated by a sear spring (not shown) in such a manner that the extension 20 on the back end is pushed against the lower end 19 of the pin-shaped connecting element 4. The sear spring (not shown) is housed in a bore 23 (as shown in FIGS. 1 and 2) on the upper surface of the trigger 3.

The sectional views of FIGS. 3-5 indicate that the bolt lock 5, which is pivotably disposed on the sear nose 2, is pushed against the stationary sear element 17 by a compression spring 24 that is disposed in the sear nose 2. The compression spring 24, with a lower and an upper pin 25 and 26, respectively, is disposed in a bore 27 in the sear nose 2. The lower pin 25, which is inserted into the lower end of the compression spring 24, rests against the upper surface of the lever arm 14 of the bolt lock 5, which lever arm, relative to the axis of rotation 13, projects in the forward direction. The upper pin 26 which is inserted into the upper end of the compression spring 24 rests against the lower end of an adjusting screw 28 which is disposed in a tapped hole 29 on the supper surface of the sear nose 2. Thus, the trigger pull can be adjusted by tightening or loosening the adjusting screw 28.

The sectional views of FIGS. 3-5 also show that the lower surface of the bolt lock 5 has a curved control surface 30 that meshes with a ramp-shaped return notch 31 on the upper surface of the stationary sear element 17.

The mechanism of action of the trigger mechanism described above will be discussed based on FIGS. 3-5.

FIG. 3 shows the trigger mechanism in a cocked position. In this position, a firing pin nut (not shown), which is actuated in the forward direction by the firing pin spring, is pushed upward against a stationary central axis by the front nose 6 of the sear nose 2. As a result, the sear nose 2 is able to hold the firing pin nut, which is actuated in the forward direction by the firing pin spring, with the firing pin in a retracted, cocked position. In this position, the groove-shaped sear 15, on the lower surface of the front lever arm 14 of the bolt lock 5, which lever arm is actuated downward by the compression spring 24, meshes with counter-sear 16, which has the form of a sear edge, on the upper surface of the stationary sear element 17. By means of the sear spring (not shown), the pin-shaped connecting element 4 is pre-tensioned via the trigger 3 in such a manner that the upper end of the connecting element 4 rests with zero backlash against the lower contact surface 19 of the lever arm 14. However, the force of the compression spring 24 is markedly higher than the force of the sear spring, so that the bolt lock 5 meshes with and locks the stationary sear element 17 into position, thus ensuring that the sear nose 2 holds the firing pin in the cocked position.

When the trigger 3 is actuated, the front lever arm 14 of the bolt lock 5 is swiveled upward against the force of the compression spring 24 by the pin-shaped connecting element 4, as seen in FIG. 4. This causes the groove-shaped sear 15 on the lower surface of the front lever arm 14 of the bolt lock 5, which lever arm is actuated downward by the compression spring 24, to become disengaged from the counter-sear 16, which has the form of a sear edge, on the stationary sear element 17, so that the sear nose 2 and the bolt lock 5, as shown in FIG. 5, can turn counterclockwise around the axis 9, thus causing the front nose 6 to be lowered. As a result, the firing pin nut (not shown) is no longer pushed against the central axis and can be moved forward by the force of the firing pin spring so as to trigger a shot.

After firing and opening the locking bolt mechanism, the firing pin nut is again pushed to the back, which allows the sear nose 2, which is actuated in the return direction by a return spring, as well as the bolt lock 5, which is actuated in the return direction by the compression spring 24, to automatically move back into the starting position shown in FIG. 1 before a rear surface of the firing pin nut comes into contact with the return nose 7 of the sear nose 2.

However, if the automatic return of the sear nose 2 and the bolt lock 5, which is initiated by the return spring and the compression spring 14 on the sear nose, does not function properly, e.g., due to freezing, breakage of the spring, contamination or the like, a manual forcible return is possible, even without return springs, via the return nose 7 that is disposed on the sear nose and the control surface 30 that is disposed on the bolt lock 5 in combination with the ramp-shaped return cam 31 on the upper surface of the stationary sear element 17.

To this end, as the firing pin nut is retracted, the sear nose 2, as FIG. 3 indicates, can be turned clockwise via the return nose 7 through a return surface on the firing pin nut in such a manner that the front nose 6 is lifted without the action of the return spring. During the return movement of the sear nose 2, the bolt lock 5, which is pivotably disposed on the sear nose 2, is rotated about the axis 8 so that the control surface 30 on the lower surface of the bolt lock meshes with the ramp-shaped return cam 31 on the upper surface of the stationary sear element 17. By way of the return cam 31, the bolt lock 5 is pushed counterclockwise about the axis of rotation 13 into its sear position even if the compression spring 24 is unable to exert an adequate returning force, e.g., due to breakage, contamination or freezing. As the sear nose 2 is rotated clockwise, the bolt lock 5 is rotated counterclockwise via the control surface 30 and the return sear and, as a result, the front lever arm 14 is pushed in the downward direction so that the groove-shaped sear 15 on the lower surface of the bolt lock 5 meshes with the counter-sear 16 of the stationary sear element 17 even without the compression spring 24. In this manner, manual forcible resetting is possible. As the bolt lock 5 is reset, the trigger 3, via the pin-shaped connecting element 4, is also reset to its front starting position against the force of the sear spring (not shown).

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A trigger mechanism of a repeating rifle comprising a sear nose that pivots about an axis and a bolt lock that is pivotally disposed to the sear nose, which bolt lock is connected to a trigger that pivots about a trigger axis and comprises a sear that meshes with a counter-sear, wherein the counter-sear is disposed on a stationary sear element and the bolt lock is disposed on the sear nose so as to be able to pivot about an axis of rotation extending below the axis around which the sear nose pivots, and wherein the bolt lock is actuated by a compression spring, the compression spring disposed in the sear nose such that the sear on the bolt lock is pushed in a direction of the counter-sear.

2. The trigger mechanism as in claim 1, wherein the compression spring is housed in a bore in the sear nose.

3. The trigger mechanism as in claim 1, wherein pre-tension of the compression spring can be changed by an adjusting screw.

4. The trigger mechanism as in claim 1, wherein the bolt lock is pivotally disposed about the axis of rotation of the bolt lock via a bearing bore in a slot-shaped groove on a lower extension of the sear nose.

5. The trigger mechanism as in claim 1, wherein the sear nose has a front nose for holding or releasing a movable firing pin assembly.

6. The trigger mechanism as in claim 1, wherein the sear nose has a rear return nose for forcibly resetting the sear nose and the bolt lock.

7. The trigger mechanism as in claim 1, wherein a control surface, which meshes with a return cam on the stationary sear element for forcibly returning the bolt lock into a sear position, is disposed on the bolt lock.

8. The trigger mechanism as in claim 1, wherein the stationary sear element and the sear nose, with the bolt lock pivotally disposed thereon, are disposed in an insert.

9. The trigger mechanism as in claim 1, wherein the trigger is connected to the bolt lock via a pin-shaped connecting element.

10. The trigger mechanism as in claim 1, wherein the stationary sear element is configured to remain stationary when the trigger mechanism is actuated.

11. A trigger mechanism for a repeating rifle, the trigger mechanism comprising:

a sear nose that pivots about an axis and a bolt lock that is pivotally disposed to the sear nose, which bolt lock is connected to a trigger that pivots about a trigger axis and comprises a sear that meshes with a counter-sear, wherein the counter-sear is disposed on a stationary sear element configured to remain stationary when the trigger mechanism is actuated and the bolt lock is disposed on the sear nose so as to be able to pivot about an axis of rotation extending below the axis around which the sear nose pivots, and wherein the bolt lock is actuated by a compression spring, the compression spring disposed in the sear nose such that the sear on the bolt lock is pushed in a direction of the counter-sear.

* * * * *